US005203099A

United States Patent [19]

Naranjo et al.

[11] Patent Number: 5,203,099

[45] Date of Patent: Apr. 20, 1993

[54] SELF-POWERED, SUBMERSIBLE DREDGE APPARATUS

[75] Inventors: Javier Naranjo; Pierre G. Mansur, both of Miami, Fla.

[73] Assignee: Commodities, Inc., Miami, Fla.

[21] Appl. No.: 863,584

[22] Filed: Apr. 3, 1992

[51] Int. Cl.[5] ..... E02F 5/28

[52] U.S. Cl. ..... 37/329; 37/313; 37/317; 37/334

[58] Field of Search ..... 37/54, 56, 58, 64, 66, 37/72

[56] References Cited

U.S. PATENT DOCUMENTS

| | | | |
|---|---|---|---|
| 3,412,862 | 11/1968 | Chaplin | 37/66 X |
| 3,500,648 | 3/1970 | Daniell | 37/56 X |
| 3,605,296 | 9/1971 | Dysart | 37/66 X |
| 3,683,521 | 8/1972 | Sloan et al. | 37/56 |
| 3,978,679 | 9/1976 | Lecomte | 37/64 X |
| 4,214,387 | 7/1980 | Boehme et al. | 37/64 X |
| 4,312,762 | 1/1982 | Blackburn et al. | 37/64 X |
| 4,713,896 | 12/1987 | Jennens | 37/54 |

FOREIGN PATENT DOCUMENTS

| | | | |
|---|---|---|---|
| 1395416 | 5/1963 | France | 37/56 |

*Primary Examiner*—Dennis L. Taylor

*Assistant Examiner*—Arlen L. Olsen

*Attorney, Agent, or Firm*—Malloy & Malloy

[57] ABSTRACT

A self-powered, self-contained mobile dredge for removing silt and other bottom sediment from the bottom surface of a body of water, such as a canal, which accumulates as a result of erosion caused by rain and irrigation. A submersible drive unit of the dredge includes a continuous track drive, including left and right tracks, providing sufficient traction and mobility while exerting minimum ground pressure to enable the dredge to be driven along the bottom surface of a canal, while further enabling entry and exit from within the canal and transit across terrain between canals. A housing is movably mounted on the drive unit and is both rotatable about an arc of 360° and vertically adjustable relative to the drive unit. A dredge unit, movable between a raised position and a lowered position extends from a forward end of the housing and includes a scoop having a tiller assembly therein. A sludge pump, mounted to the scoop in fluid communication with an open mouth thereof, is structured to intake a mixture of the bottom sediment and water which is force fed into the tiller assembly as the dredge moves forward, the pump simultaneously discharging the mixture through an angularly adjustable discharge chute for even disbursement over the terrain adjacent the canal.

8 Claims, 2 Drawing Sheets

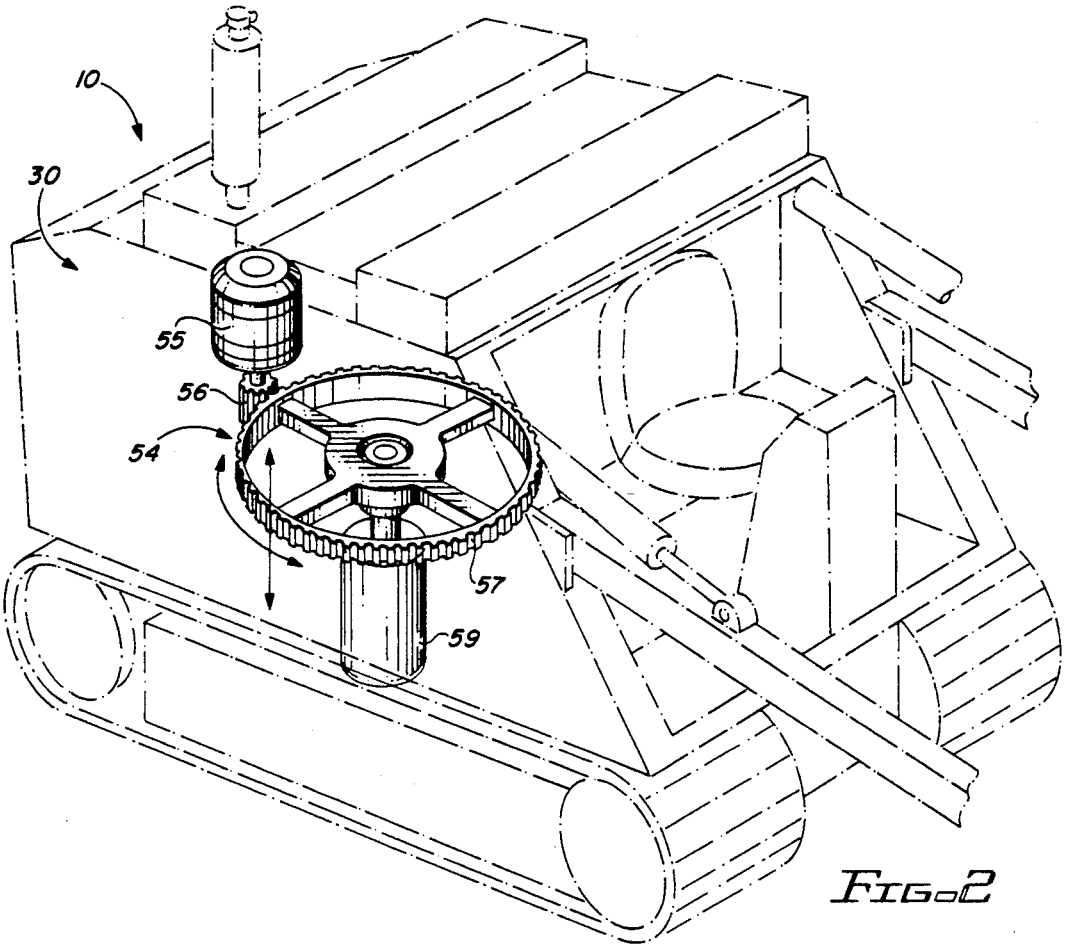
FIG. 2
FIG. 3
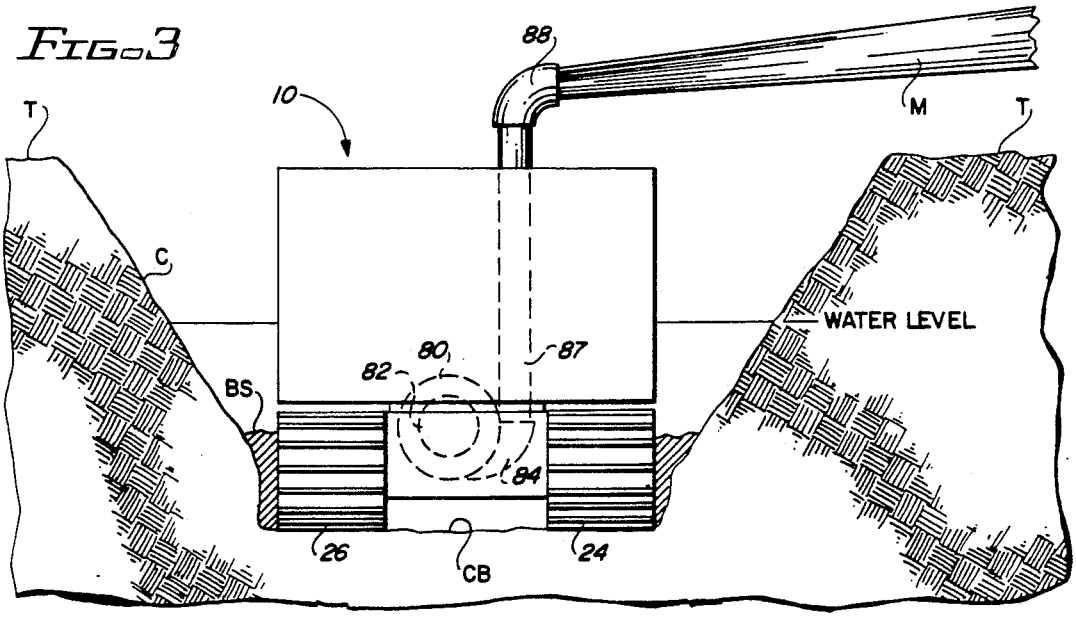

SELF-POWERED, SUBMERSIBLE DREDGE APPARATUS

BACKGROUND OF THE INVENTION

1. Field of the Invention

The present invention is directed to a self-powered, self-contained mobile dredge apparatus which is substantially submersible and is adapted to be driven along the bottom surface of a body of water, such as a canal, for removing a bottom layer of accumulated silt and other sediment resulting from erosion caused by rain and irrigation, while simultaneously dispersing a mixture of the bottom sediment and water effectively across the surrounding terrain.

2. Description of the Related Art

In order to provide sufficient water to growing crops, it is common for many plantation fields to be equipped with irrigation systems which deliver and disperse large quantities of water throughout the field. It is also common for plantation fields, such as banana plantations and sugar plantations, to be located in climates which produce a significant amount of annual rainfall, thus subsidizing the irrigation systems. In order to properly drain the water supplied through irrigation and rainfall, most plantation fields, and specifically banana and sugar plantations, include drainage canals extending in spaced, parallel relation through the fields. Any excess runoff of rain and irrigation water fills into the canals and flows downstream where, once collected, it might be resupplied throughout the fields through the irrigation system.

A common problem associated with virtually all drainage and irrigation canals in plantation fields is blockage resulting from a build-up of silt which deposits on the bottom of the canals due to erosion of topsoil caused by rain and irrigation. In order to ensure that the canals remain at a predetermined depth and therefore function properly, it is required to periodically remove the silt build-up from the bottom of the canals, redepositing the soil back onto the bordering plantation field. Ordinarily, this is achieved by either removing the accumulated silt build-up manually with shovels or through the use of a back hoe positioned along a bank of the canal. In either event, the removed silt is thereafter deposited into piles or mounds along the banks of the canal. It is thereafter required to disperse the piles of soil evenly across the surrounding plantation fields in order to prevent rapid and excessive erosion along the canal banks. In using a back hoe, the bottom sediment is removed in bulk, and it is common that large rocks, sticks, and other undesirable objects are removed along with the bottom sediment. The removed sediment must then be filtered, usually by laborers who sift through the mounds with their feet, prior to dispersing throughout the fields, in order to separate large objects, such as rocks, which might damage harvesting machinery used in the plantation fields. Accordingly, there are generally two distinct and separate processes which are ordinarily employed in order to maintain drainage canals at a predetermined depth, namely removing the accumulated silt build-up from the bottom of the canals and subsequently dispersing the piles of soil from along the canal banks. And, in using a back hoe it is also necessary to filter the sediment prior to dispersing in order to remove large objects. This practice has proved to be extremely time-consuming and expensive, requiring a considerably large number of laborers whose progress is limited to a large extent by the process employed and equipment being used. Because many plantation fields, such as banana plantations, are located in rainy climates, the rate of erosion is rather rapid and, when coupled by the rate at which the canals can be cleared, the maintenance of the canals becomes a constant problem. Further, in climates having heavy rainfall, the ground pressure is usually not sufficient to handle heavy equipment such as back hoes which, weighing approximately 30,000 to 50,000 pounds, tend to sink in the soil along the canal banks. This further adds to the time-consuming task of clearing the canals, requiring most of the work to be performed manually.

Other methods of clearing drainage canals have employed the use of dredges on pontoons or other similar floating structures which are navigated along the canals, while a pump is used to suck the accumulated silt from the bottom of the canal. In most instances, the bottom sediment is then discharged through pipes which lead to a distant location. As the floating dredge progress along the canal, a considerable number of laborers are needed in order to disassemble the pipes, move them and reassemble a new pipe line leading from the repositioned dredge. A common problem encountered when using dredges of this type, which float on the surface of the water, is the inability to move the dredge unit against the layer of accumulated silt build-up in a matter which effectively force feeds the pump and thereby accelerates the dredging process. A further problem is encountered in dry seasons when using floating dredge assemblies, due to the usual low water level in the canals which prevents navigation of the floating dredges therealong. And of course, a common problem associated with all of the equipment in the related art is the difficulty in transporting the equipment between adjacent canals.

In view of the aforementioned problems presently associated in removing bottom sediment and silt build-up on the bottom of drainage canals, it is an object of the present invention to provide a fully mobile, totally submersible dredge apparatus which is structured to be driven on the bottom surface of canals to rapidly remove accumulated silt build-up on the bottom of canals while simultaneously returning and dispersing the silt evenly across the surrounding terrain.

It is another object of the present invention to provide a self-contained, self-powered dredge apparatus which is adapted to be driven into and out of canals and across terrain between canals thus effectively reducing the time and labor involved in transporting equipment.

It is a further object of the present invention to provide a submersible dredge apparatus which includes a high torque submersible track drive system which is structured to move the dredge apparatus along virtually any terrain, including a bottom surface of the canal, force feeding the accumulated bottom sediment and silt build-up into a dredge unit thereof, while the track drive system simultaneously compacts the dredged canal bottom.

It is yet a further object of the present invention to provide a compact, self-powered and self-contained dredge apparatus which is easily navigable through narrow drainage and irrigation canals and through surrounding plantation fields.

It is still a further object of the present invention to provide a self-powered, self-contained dredge apparatus which is structured to rapidly and efficiently remove accumulated bottom sediment and silt build-up from the bottom of drainage and irrigation canals, while simultaneously dispersing a slurry made up of at least 40% solids evenly across the surrounding terrain.

It is a further object of the present invention to provide a self-powered, compact, highly maneuverable dredge apparatus which is structured to effectively operate in a body of water, such as a canal, having a minimum water level of 4".

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 2 is an isolated view of a rotation means and vertical adjustment means connecting between a housing and a drive unit of the present invention.

FIG. 3 is an end view of the dredge apparatus of the present invention shown in operation within a drainage canal.

Like reference numerals refer to like parts throughout the several views of the drawings.

DETAILED DESCRIPTION OF THE PREFERRED EMBODIMENT

Figure 1:
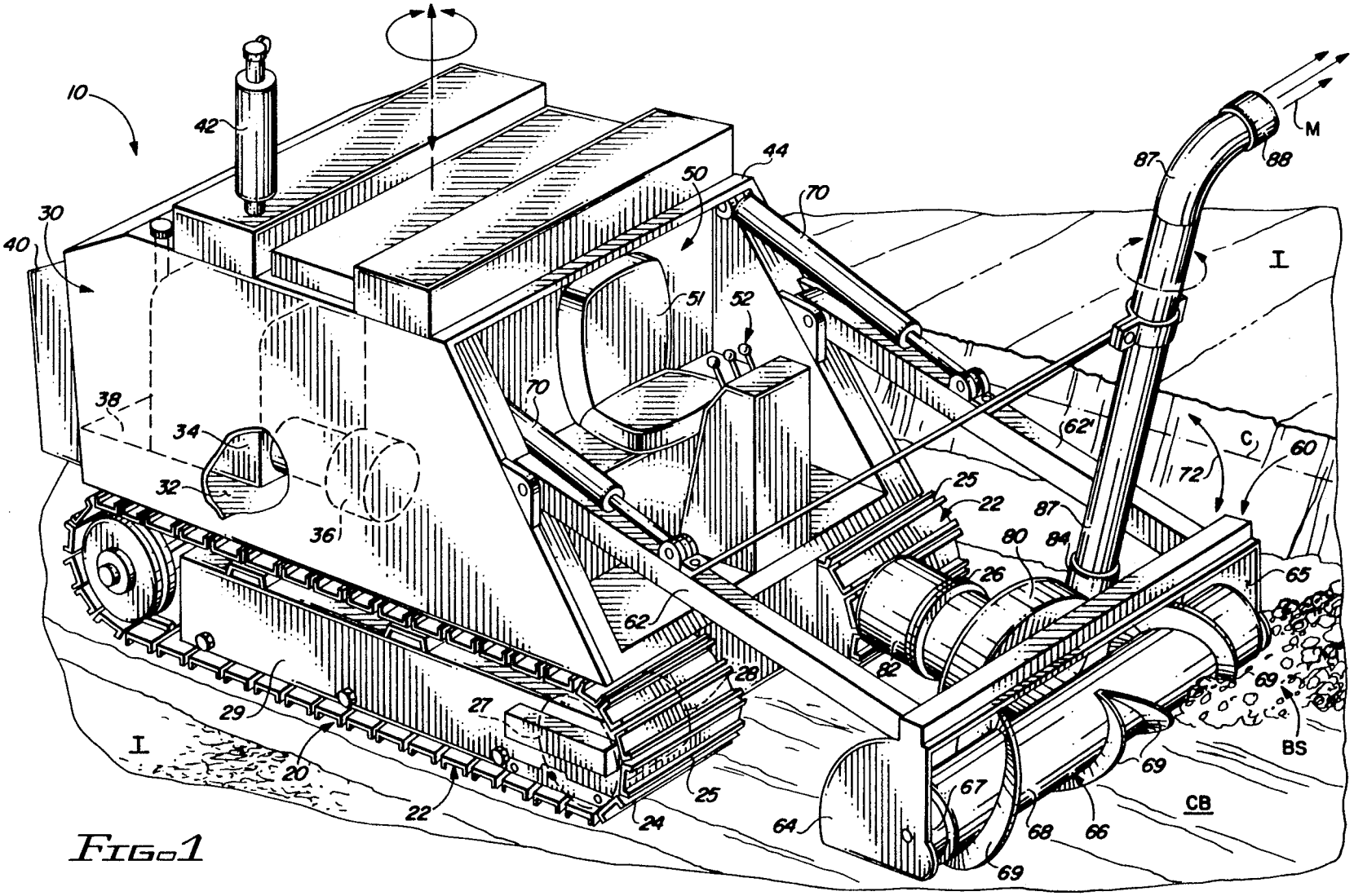
FIG. 1 is a perspective view of the canal dredge apparatus of the present invention.

With reference initially to FIG. 1, there is illustrated generally a dredge apparatus 10 of the present invention which is structured to be driven along a bottom surface BS of a canal C as commonly found in plantation fields. The dredge apparatus 10 includes a submersible drive unit 20 having a track drive system 22 extending substantially along a length thereof. The track drive system 22 includes a right track drive 24 and a left track drive 26 having tread means 25 thereon adapted to engage virtually any underlying ground surface to enable the dredge apparatus 10 to be propelled therealong. A drive wheel 27 in each of the left and right track drives 24, 26 is driven by a hydraulic drive motor 28. The drive wheel 27 engages the corresponding track drive 24 or 26 such that, upon driven rotation by the hydraulic motor, the belt track 24 and/or 26 is rotated in either a forward or reverse direction as desired. The drive unit further incorporates a hydraulic oil reservoir 29 extending substantially thereacross and being structured to contain hydraulic fluid therein for use as needed by a hydraulic actuation means to be described in more detail hereinafter.

A housing 30 is movably mounted on the drive unit and includes an interior compartment 32 which is completely sealed and watertight. An engine package 34 is mounted within the interior compartment and is drivingly interconnected with hydraulic pumps 36. Also contained within the interior compartment 32 are fuel tanks 38 which supply fuel to the engine 34. Air intake means 40 and air exhaust means 42 are provided on the housing to facilitate proper ventilation of the interior compartment. A cover 44 is movable between an open and closed position to provide access to the interior compartment 32 and components therein.

A cockpit area 50 is provided on a forward end of the housing 30 and includes a driver's seat 51 and controls 52 accessible to a driver of the dredge apparatus 10 to enable operation of various components thereof.

As best illustrated in FIG. 2, the housing 30 includes rotating means 54 connecting the housing 30 to the drive unit 20 to provide controlled rotation of the housing about an arc of 360° relative to the drive unit 20. In a preferred embodiment, the rotating means 54 includes a hydraulic motor 55 and attached gear 56 mounted to a lower portion of the housing 30. The gear 56 is positioned to engage the surface of a ring gear 57 attached to an upper portion of the drive unit 20. Driven rotation of gear 56 by motor 55 causes the gear 56 to orbit the ring gear 57 resulting in rotation of the entire housing 30. Further connecting between the housing 30 and the drive unit 20 is a height adjustment means 58 which enables controlled vertical adjustment of the housing height relative to the drive unit 20 and water level within the canal C. The height adjustment means includes a hydraulic piston 59 connecting between the housing 30 and the drive unit 20. The piston 59 is preferably concentrically oriented with the ring gear 57 and is rotatable. In this manner, the housing 30 can be raised and lowered throughout a predetermined range, depending on the length of the piston, while also being able to be rotated about a central axis common to both the piston 59 and the ring gear 57 of the rotating means 54.

Connected to and extending from a forward end of the housing 30 is a dredge unit 60 which is movable between a raised position and a lowered, operable position. A right arm 62 and a left arm 60' hingedly connect to the forward end of the housing 30 and extend angularly downward attaching to a shell structure defining a scoop 64 having an open mouth portion 65. Extending across the width of the scoop 64 and exposed through the mouth portion 65 is a tiller assembly 66. The tiller assembly 66 includes a shaft 67 extending across the width of the scoop and including tillers 68 rotatably mounted thereon. The tillers further include chines 69 extending outwardly, being structured and disposed to churn a layer of bottom sediment S to be removed from the bottom surface BS of the canal C while force feeding the sediment into the mouth 65 of the scoop 64 as the dredge progresses in a forward direction. A pair of hydraulic pistons 70, 70' each connect between the housing 30 and a respective one of the arms 62, 62'. The pistons 70 are operatively connected with the hydraulic pumps 36 within the interior compartment 32, whereupon control of the pumps by controls 52 serves to actuate the pistons, thereby enabling raising and lowering of the dredge unit 60 between the raised position and lowered position as indicated by arrows 72.

A sludge pump 80 is mounted to the scoop 64 in fluid communication with the open mouth and includes a pump motor 82 thereon. Actuation of the pump motor 82 serves to operate an impeller which feeds a mixture of water and sediment S through an intake of the pump for subsequent forced discharge through a pump discharge 84. A discharge chute 86 is rotatably attachable to the pump discharge 84 and is structured to receive the discharged mixture of water and sediment for dispersement out through a distal end 88 thereof, evenly distributing the mixture M across the surrounding terrain T to distances exceeding 30 feet from the canal's edge. The discharge chute 86 may be provided with a bend 87 to angularly position the distal end 88 in a preferred orientation relative to the surrounding terrain T.

Now that the invention has been described, what is claimed is:

1. A dredge apparatus for removing accumulated bottom sediment from the bottom surface of a body of water, said apparatus comprising:

a drive unit including drive means thereon structured and disposed to drivingly engage the bottom surface of the body of water, a housing movable attached to an upper portion of said drive unit and including an interior compartment and an exterior operator control portion including an operator's seat and operating controls, a dredge unit movably attached to an end of said housing and extending therefrom, said dredge unit being movable between a raised position and a lowered, operable position, said dredge unit including a dredge assembly attached to a free distal end thereof and including an open mouth portion structured and disposed to be at least partially submerged below a water surface level of the body of water such that when said dredge unit is in said lowered, operable position, the bottom sediment is force fed into said open mouth as said drive unit moves the apparatus and attached dredge unit along the bottom surface in a forward direction in relation to the position of said housing and attached dredge unit, pump means attached to said dredge unit including an intake disposed in fluid communication with said open mouth structured and disposed to intake a mixture of the bottom sediment and water being force fed into said open mouth, and an output structured and disposed to subsequently discharge said mixture forcefully therefrom, a discharge chute rotatably attached to and extending upwardly from said output of said pump means and terminating at an upper free distal end in spaced relation above said drive unit, said distal end of said discharge chute being structured and disposed to evenly disperse and distribute the discharge of said mixture throughout a range of at least 30 feet in radius, power means within said compartment of said housing, structured to operatively engage said drive means and said dredge unit for operation thereof, control means at said control portion for operatively controlling said power means, thereby facilitating operative control of said drive means and said dredge unit, rotation means interconnected between said drive unit and said housing and structured for controlled, adjusted rotation of said housing and said dredge unit about an arc of 360° relative to said drive unit, and vertical adjustment means interconnected between said drive unit and said housing and structured to facilitate controlled vertical adjustment of said housing relative to said drive unit throughout a predetermined range of height.

2. A dredge apparatus as set forth in claim 1 wherein said drive means includes a continuous track drive system including a right track and a left track each having traction means thereon for driving engagement with the bottom surface.

3. A dredge apparatus as set forth in claim 2 wherein said right and left tracks extend longitudinally along a length of said drive unit on said opposite sides thereof.

4. A dredge apparatus as set forth in claim 2 wherein said power means includes hydraulic actuation means including at least one hydraulic pump structured to hydraulically operate said track drive system and said dredge unit.

5. A dredge apparatus as set forth in claim 4 wherein said dredge unit includes a pair of opposite extending arms including a left arm and a right arm hingedly attached to and extending from opposite sides of a forward end of said housing in parallel relation to one another.

6. A dredge apparatus as set forth in claim 5 wherein said dredge unit further includes a pair of hydraulic pistons including a first hydraulic piston and a second hydraulic piston, each interconnecting between a corresponding one of said arms, at substantially a mid-portion thereof, and said housing, wherein actuation of said hydraulic pistons by said hydraulic actuation means serves to move said dredge unit between said raised position and said lowered, operable position.

7. A dredge apparatus as set forth in claim 6 wherein said rotation means and said vertical adjustment means are hydraulically actuated by said hydraulic actuation means.

8. A dredge apparatus as set forth in claim 1 wherein said interior compartment of said housing includes fuel storage tanks therein connected in fuel supplying relation to said power means.

* * * * *